US011026551B2

(12) United States Patent
Supron et al.

(10) Patent No.: US 11,026,551 B2
(45) Date of Patent: Jun. 8, 2021

(54) SUSPENSION SYSTEM, METHODS, AND APPLICATIONS

(71) Applicant: Maidbot, Inc., Austin, TX (US)

(72) Inventors: Steve Supron, Ithaca, NY (US); Steven Whitehead, Austin, TX (US); David Moroniti, Austin, TX (US); Micah Green, Austin, TX (US)

(73) Assignee: Maidbot, Inc., Austin, TX (US)

( * ) Notice: Subject to any disclaimer, the term of this patent is extended or adjusted under 35 U.S.C. 154(b) by 341 days.

(21) Appl. No.: 16/164,871

(22) Filed: Oct. 19, 2018

(65) Prior Publication Data

US 2019/0117032 A1 Apr. 25, 2019

Related U.S. Application Data

(60) Provisional application No. 62/574,255, filed on Oct. 19, 2017.

(51) Int. Cl.

| | |
|---|---|
| ***A47L 11/40*** | (2006.01) |
| ***A47L 11/24*** | (2006.01) |
| ***A47L 9/22*** | (2006.01) |
| ***A47L 9/00*** | (2006.01) |

(52) U.S. Cl.

CPC ..... *A47L 11/40* (2013.01); *A47L 9/009* (2013.01); *A47L 11/24* (2013.01); *A47L 2201/00* (2013.01); *A47L 2201/04* (2013.01)

(58) Field of Classification Search

CPC ..... A47L 11/40; A47L 11/24; A47L 2201/00; A47L 2201/04; A47L 11/4063; A47L 11/4066

See application file for complete search history.

(56) References Cited

U.S. PATENT DOCUMENTS

| | | | |
|---|---|---|---|
| 5,374,879 | A | 12/1994 | Pin et al. |
| 7,568,536 | B2 | 8/2009 | Yu et al. |
| 9,033,079 | B2 | 5/2015 | Shin et al. |
| 10,800,527 | B2 * | 10/2020 | Puthiyaveettil ..... B60B 19/003 |

(Continued)

FOREIGN PATENT DOCUMENTS

| | | |
|---|---|---|
| CN | 204 071 957 U | 1/2015 |
| JP | 2014-014560 A | 1/2014 |

(Continued)

OTHER PUBLICATIONS

European Patent Office, Extended European Search Report, EP Patent Application No. 18201013.2, dated Mar. 14, 2019, nine pages.

(Continued)

*Primary Examiner* — Dung Van Nguyen
(74) *Attorney, Agent, or Firm* — Fenwick & West LLP

(57) ABSTRACT

An independent suspension system for a robot vacuum cleaner with a hinge component attached to an L-shaped bracket having a horizontal flange portion and a vertical flange portion. The vertical flange portion is attached to a wheel assembly of the robot vacuum cleaner and a spring is coupled to the horizontal flange portion. A pin is attached to and extends from the vertical flange portion. A holding component is within a wheel well of the robot vacuum cleaner and is movable between an engaged configuration with the pin and a disengaged configuration with the pin.

9 Claims, 10 Drawing Sheets

(56) References Cited

U.S. PATENT DOCUMENTS

| | | | | |
|---|---|---|---|---|
| 2002/0112899 | A1 | 8/2002 | Dijksman et al. | |
| 2009/0314318 | A1 | 12/2009 | Chang | |
| 2012/0181099 | A1* | 7/2012 | Moon | A47L 9/009 180/65.51 |
| 2019/0133401 | A1* | 5/2019 | Zita | A47L 11/4063 |

FOREIGN PATENT DOCUMENTS

| | | |
|---|---|---|
| WO | 2016093910 | 6/2016 |
| WO | WO 2016/116222 | 7/2016 |
| WO | WO 2016/116223 | 7/2016 |

OTHER PUBLICATIONS

Extended European Search Report for Application No. 18201529.7 dated Apr. 3, 2019; 7 pages.

* cited by examiner

SUSPENSION SYSTEM, METHODS, AND APPLICATIONS

CROSS-REFERENCE TO RELATED APPLICATION

This application claims priority to U.S. Provisional Patent Application Ser. No. 62/574,255, filed Oct. 19, 2017 and entitled "SUSPENSION SYSTEM, METHODS, AND APPLICATIONS," the entire disclosure of which is incorporated herein by reference.

FIELD OF THE INVENTION

The present disclosure is directed generally to a vehicle suspension system for a drivable platform; more particularly, to a suspension system for a vacuum cleaner; and, most particularly, to a suspension system for a robotic vacuum cleaner, associated methods, and applications.

BACKGROUND

Cleaning patterns available to be executed with existing robotic floor cleaners are limited by their architecture, control, sensing and drive systems. Commercial robotic vacuum cleaners such as the Dyson® Eye, the Roomba®, and many of Samsung's models use a non-holonomic drive system; i.e., the drives use two independently powered wheels and a caster to provide 3-point support for their robotic vacuum cleaners. The two independently powered wheels can be used to move the robot body in a straight line, a curved line, or to spin; however, each of these drive systems are only able to move the robotic vacuum cleaner in a direction that is not perpendicular to the assigned (fixed) orientation of the robotic vacuum cleaner.

When non-holonomic robots move, e.g., northerly and then easterly, the robot must drive north, spin 90 degrees to the right, and drive east or, alternatively; they could drive north, rotate 90 degrees to the right while moving forward through an arc, and then drive east. In any case, the non-holonomic drive robotic vacuum cleaner began facing in one direction (e.g., north, south, east, west) and finished facing in a different direction, e.g., (east, west).

A robotic vacuum cleaner equipped with a holonomic drive can drive in a given direction, e.g., north (with its assigned orientation being north) and move in a different direction, e.g., east, north-east, or any direction) while maintaining its assigned orientation or that of any desired portion of the robot such as an intake, bank of sensors, or any other portion of the robot that is needed for a particular maneuver.

Further, the wheels of a vacuum cleaner need to have a limited amount of movement to overcome small variations in the surface being vacuumed. The wheels of a robotic vacuum cleaner provide propulsion and turning ability to the robotic vacuum cleaner; therefore, it is important that the wheels maintain contact with the floor to maintain control, e.g., allowing it to climb over obstacles such as a door threshold without losing drive or control.

Using four 'Omni' wheels requires that each wheel be in good contact with the ground for accurate maneuvering. Normally, with a solid chassis, only three points will make ideal contact, which on an 'Omni' platform can lead to slippage and incorrect driving characteristics.

Accordingly, there is a need in the art for a suspension system for a robotic vacuum cleaner that has an independent suspension system for each wheel assembly to ensure that all the wheels are properly loaded and can properly maneuver the robotic vacuum cleaner.

SUMMARY

The present disclosure is directed to a robotic vacuum cleaner equipped with a holonomic drive that can drive in a given direction, e.g., north (with its assigned orientation being north) and move in a different direction, e.g., east, north-east, or any direction) while maintaining its assigned orientation or that of any desired portion of the robot such as an intake, bank of sensors, or any other portion of the robot that is needed for a particular maneuver.

Moreover, advantages and benefits are realized by a robotic vacuum cleaner (or floor cleaner) having enhanced cleaning and maneuvering capability enabled by an omni-directional and holonomic drive platform exhibiting decoupled rotational and translational degrees of freedom. The advantages of being able to uniquely maneuver a robotic floor cleaner with holonomic drive can be exploited during spot cleaning, cleaning the edges of an area, putting sensors in places they are needed, navigating obstacles, and others that would be recognized by those skilled in the art to realize more efficient cleaning.

According to an aspect the present invention is an independent suspension system for a robot vacuum cleaner. The independent suspension system for a robot vacuum cleaner includes a hinge component attached to an L-shaped bracket having a horizontal flange portion and a vertical flange portion. The vertical flange portion is attached to a wheel assembly of the robot vacuum cleaner and a spring is coupled to the horizontal flange portion. A pin is attached to and extends from the vertical flange portion. A holding component is within a wheel well of the robot vacuum cleaner and is movable between an engaged configuration with the pin and a disengaged configuration with the pin.

According to an embodiment, wheel assembly is rotatable approximately 180 degrees about the hinge component.

According to an embodiment, the spring is one of a leaf spring, a compression spring, and a torsion spring.

According to an embodiment, the independent suspension system also includes one or more bumpers attached to at least one of the horizontal flange portion and the vertical flange portion.

According to an embodiment, the bumpers are composed of resilient material.

According to another aspect, the independent suspension system for a robot vacuum cleaner includes a hinge component attached to an L-shaped bracket. The L-shaped bracket has a horizontal flange portion and a vertical flange portion. The vertical flange portion is attached to a motor pod of the robot vacuum cleaner. The motor pod houses the drive motor and motor controller of the robot vacuum cleaner. A clip is mounted to the motor pod and a suspension pin is mounted between two springs in a spring holster in a wheel well of the robot vacuum cleaner. The motor pod is rotatable about the hinge component between an open position wherein the suspension pin does not engage the clip and a closed position wherein the suspension pin engages the clip.

According to an embodiment, gussets extend between the horizontal flange portion and the vertical flange portion of the L-shaped bracket.

According to an embodiment, the two springs are compression springs.

According to an embodiment, the independent suspension system also includes a receptacle configured for connection to the motor controller.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

Aspects of the present invention and certain features, advantages, and details thereof, are explained more fully below with reference to the non-limiting examples illustrated in the accompanying drawings. Descriptions of well-known structures are omitted so as not to unnecessarily obscure the invention in detail. It should be understood, however, that the detailed description and the specific non-limiting examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

An aspect of the invention is a suspension system for a robotic vacuum cleaner. An exemplary robot vacuum cleaner is shown and described in U.S. patent application Ser. No. 16/162,463, the contents of which are hereby incorporated by referenced in their entirety. An embodied suspension system generally includes a hinge, one or more springs, and a holding mechanism. Resilient bumpers and/or a pin may be further included. A suspension assembly may further include a holding component engageable with a pin of the suspension system. A respective independent suspension system is associated with a respective wheel of the robotic vacuum cleaner, thus a robotic vacuum cleaner having four wheels would have four respective independent suspension systems. Such independent suspension systems allow the vacuum cleaner wheels to be pivoted, removed, and cleaned and/or serviced without the need for tools. The embodied suspension system for a robotic vacuum cleaner enables a small amount (e.g., <0.5 inch) of independent movement of the wheels to enable the robot to traverse small bumps or discontinuities in the surface being vacuumed and also allows wheels to be pivoted for removal or replacement.

Figure 1:
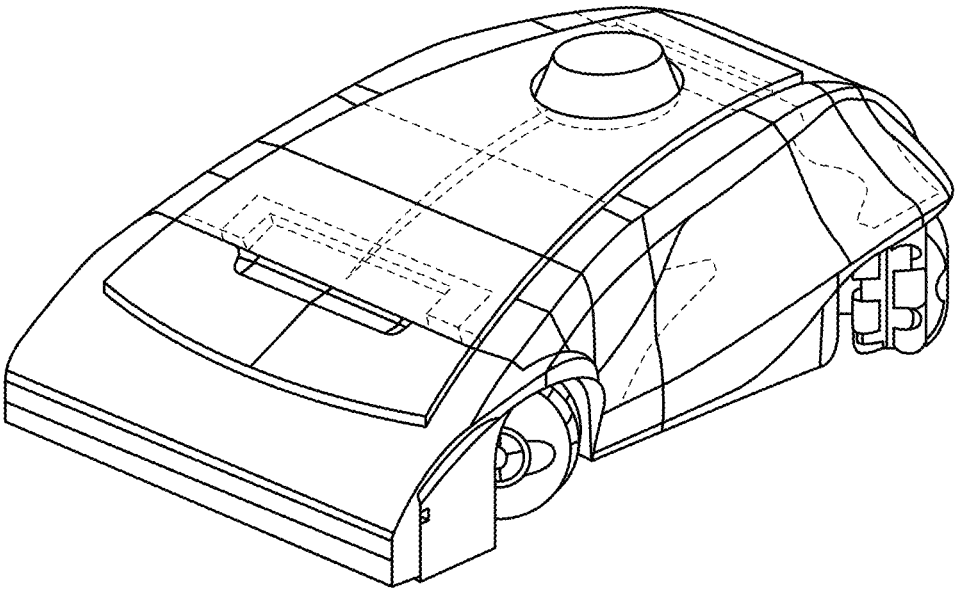
FIG. 1 is an exemplary robotic vacuum cleaner having four powered, maneuverable wheel assemblies, comprising the embodied suspension system(s).

Referring now to the figures, wherein like reference numerals refer to like parts throughout, FIG. 1 shows an exemplary robotic vacuum cleaner having four powered, maneuverable wheel assemblies, comprising the embodied suspension system(s). The suspension attaches the wheel assemblies to a chassis of the vacuum cleaner. Without compliance only three wheels will be in contact with the floor at any time. The independent suspension of each of the four wheels allows all four wheels to be in contact with the floor to drive and control the robotic vacuum. Though shown with 'Omni' or Mecanum wheels, this type of suspension may be used with other types of wheels.

Figure 2A:
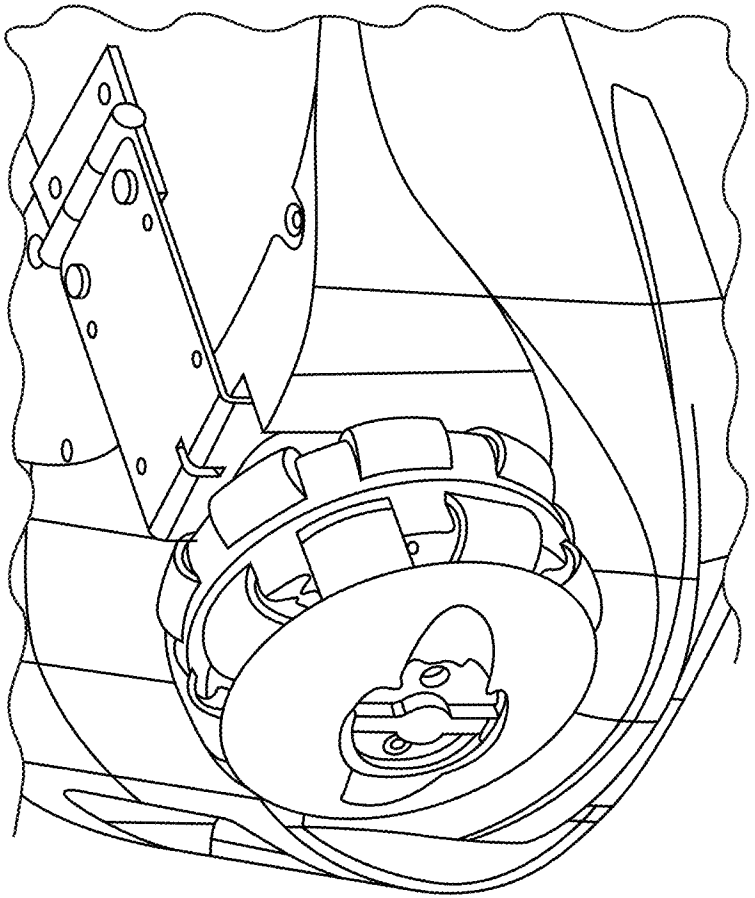
FIG. 2A is an underside view of the robotic vacuum cleaner showing one embodied independent suspension system connected to a wheel assembly.
Figure 2B:
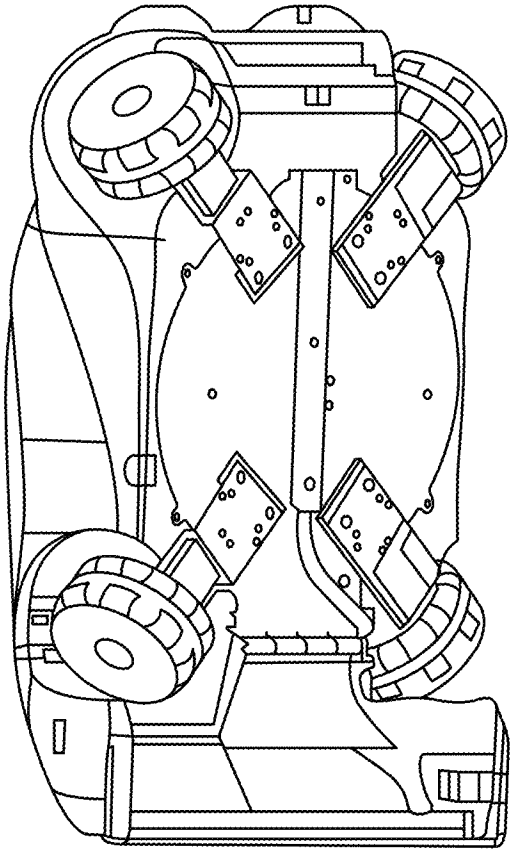
FIG. 2B is a four-wheel suspension system installed on the underside of the robotic platform.

Turning now to FIG. 2A there is shown an underside view of the robotic vacuum cleaner showing one embodied independent suspension system connected to a wheel assembly. Each of the four suspension systems are attached to the vacuum cleaner chassis through a simple hinge as shown. The hinge allows up and down movement of the wheel. The hinge may be screwed, welded, or otherwise attached to the vacuum cleaner base. FIG. 2B schematically illustrates the four-wheel suspension system installed on the underside of the robotic platform. Other embodiments of the suspension system described herein below will similarly attach to the underside of the vacuum cleaner platform.

Figure 3:
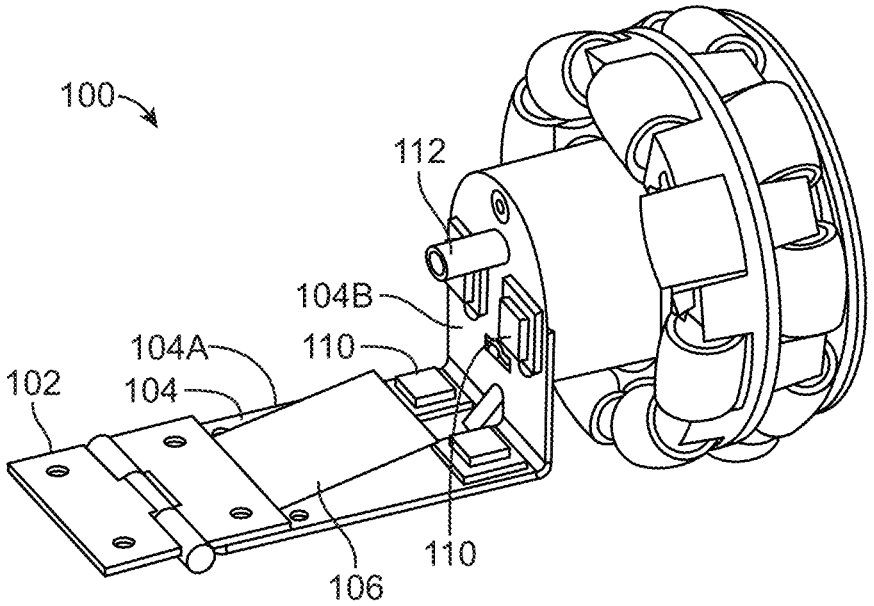
FIG. 3 is an exemplary independent suspension system connected to a respective wheel assembly.

Referring now to FIG. 3, there is shown an exemplary independent suspension system 100 connected to a respective wheel assembly. The independent suspension system 100 includes a hinge component 102 attached to an L-shaped bracket 104 characterized by a horizontal flange portion 104A and a vertical flange portion 104B. The vertical flange 104B is attached to the wheel assembly as illustrated. The L-shaped bracket is advantageously made of metal or other suitable material providing sufficient strength, flexibility, durability, and cost effectiveness.

Still referring to FIG. 3, a simple leaf spring 106 is coupled to the horizontal flange portion 104A and provides for limited (e.g., up to 0.5 in) resilient up/down movement of the wheel assembly while the robotic vacuum cleaner operationally moves along a floor. The spring 106 can be unique for each wheel to provide balanced support to the robotic vacuum. While a leaf spring 106 is shown, the spring force could also be provided by a compression or torsion spring as one skilled in the art would recognize. When the robotic vacuum cleaner is not in operational use, the hinge component 102 allows the suspension and attached wheel assembly to be swung away from the underside of the vacuum cleaner almost 180 degrees as limited by the wheel diameter, for cleaning, wheel removal, access, etc.

As shown in FIG. 3, a plurality of (advantageously, four) rubber or other resilient material bumpers 110 may be attached to the horizontal and vertical flanges 104A, 104B of the L-bracket 104 substantially as shown. The bumpers 110 cushion the robot when the wheel rolls over a bump or an abrupt surface change, or when the robot is dropped and the brackets 102 the full up/rotated position. The bumpers 110 also dampen the sound of the wheel brackets interacting with the vacuum cleaner housing. A pin 112 may be attached to the vertical flange 104B. The pin 112, when engaged with a holding component, described below, is used to limit the movement of the wheel towards the housing when the vacuum cleaner is in operational use. FIG. 3 shows the pin 112 as a stud threaded into a PEM Nut of the bracket 104. A simple screw can also be threaded into the PEM Nut and act as the pin 112.

Figure 4A:
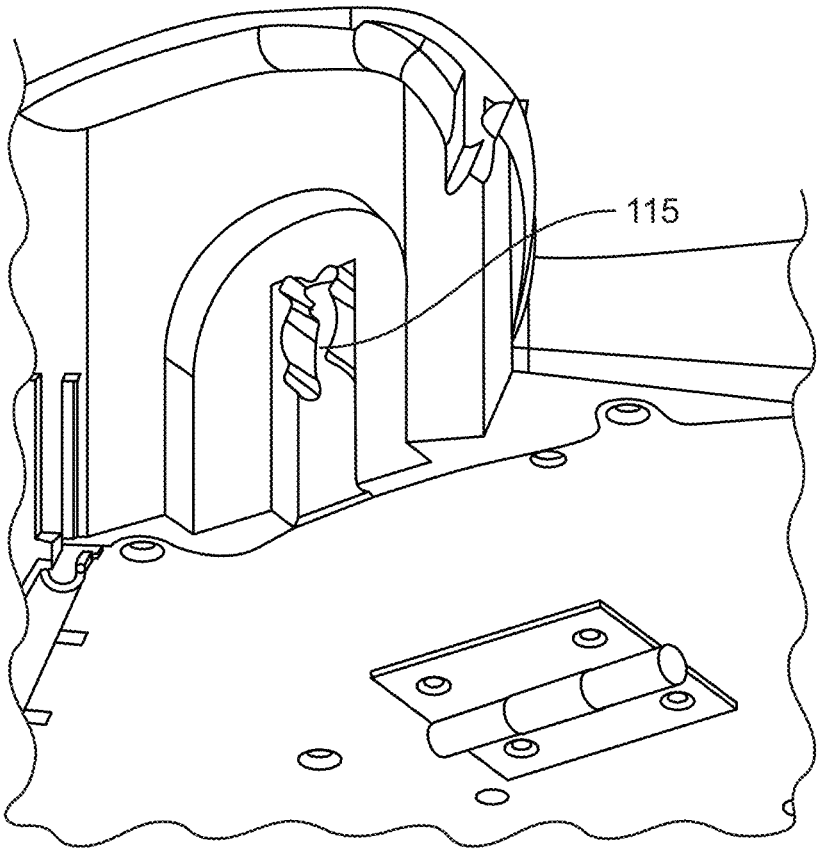
FIG. 4A is a wheel well within the vacuum cleaner chassis and a pin holding component.
Figure 4B:
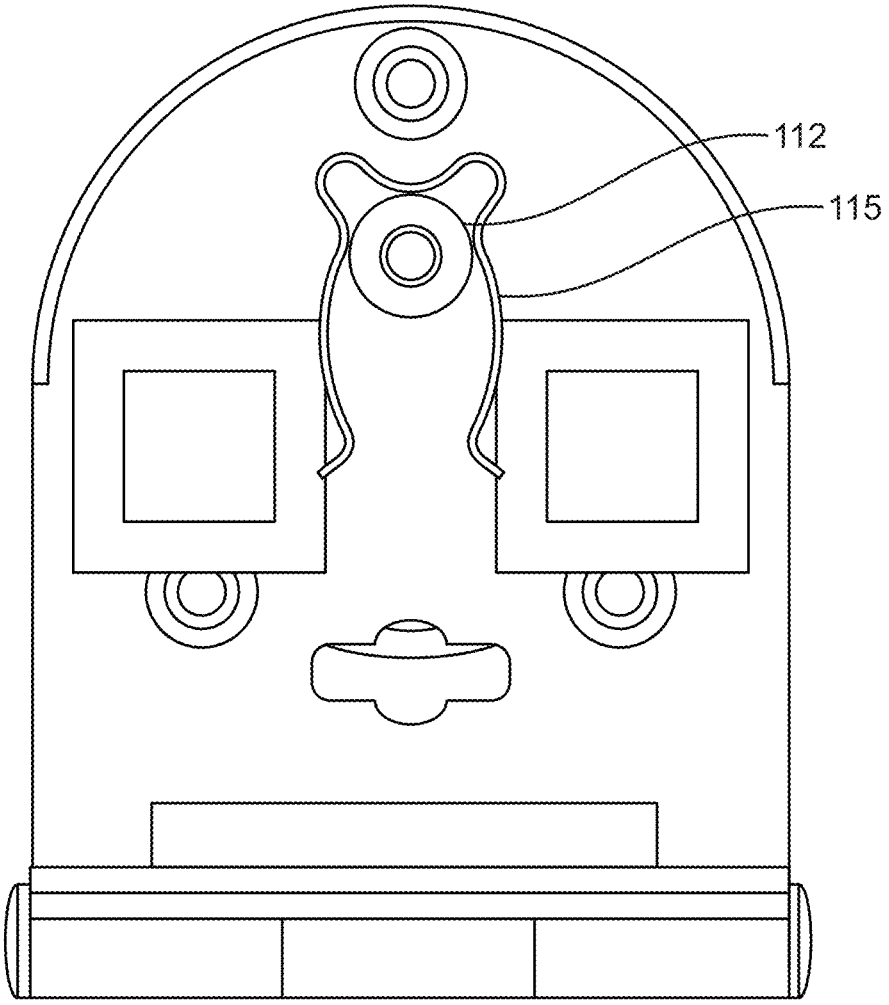
FIG. 4B is the pin of the suspension system engaging the clip when the wheel bracket assembly is rotated about the hinge into the near horizontal/operational position.

Turning now to FIG. 4A, there is shown a wheel well within the vacuum cleaner chassis and a pin holding component 115. As illustrated, the pin holding component 115 is a simple, commercial spring "tool hold" clip. The pin 112 of the suspension system 100 engages the clip 115 when the wheel bracket assembly is rotated about the hinge 102 into the near horizontal/operational position, as illustrated in FIG. 4B. The pin holding component 115 and pin 112 are configured to allow a limited amount of vertical movement (up to approximately 0.5 in) of the suspension system 100.

In normal operation, the spring 106 pushes the L-bracket 104 downward until the pin 112 reaches the bottom of the holding component 115. Furthermore, the clip 115, hinge 102, and bracket 104 allow the wheel bracket to be pivoted from the clip 115 for service, removal or replacement of the wheel without the need for special tools. The engagement of the pin 112 with the holding component 115 is chosen to provide a low enough force for easy opening and closing of the suspension system 100 (about 1.5 lbs. depending upon materials), while maintaining sufficient force to hold the wheel assembly within the holding component 115 during lifting and normal handling of the robotic vacuum cleaner. Although a commercial "tool holder" spring clip 115 is shown for low cost and commercial availability, various spring clips or custom pin holders are envisioned.

Figure 5A:
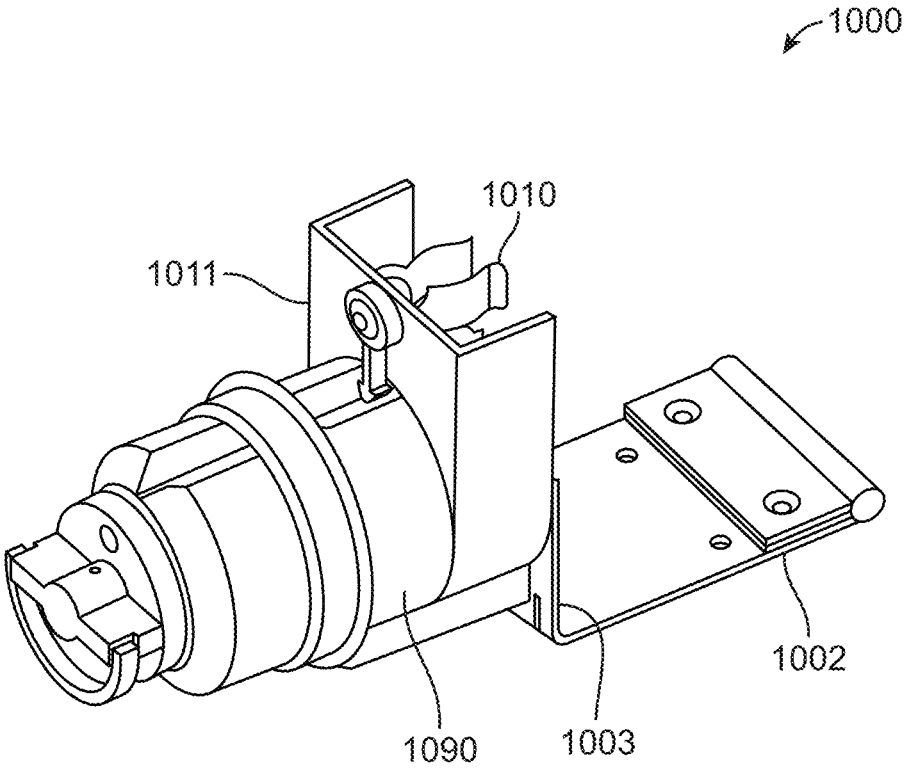
FIG. 5A is a front view of another exemplary independent suspension system connected to a respective motor pod/wheel assembly.
Figure 5B:
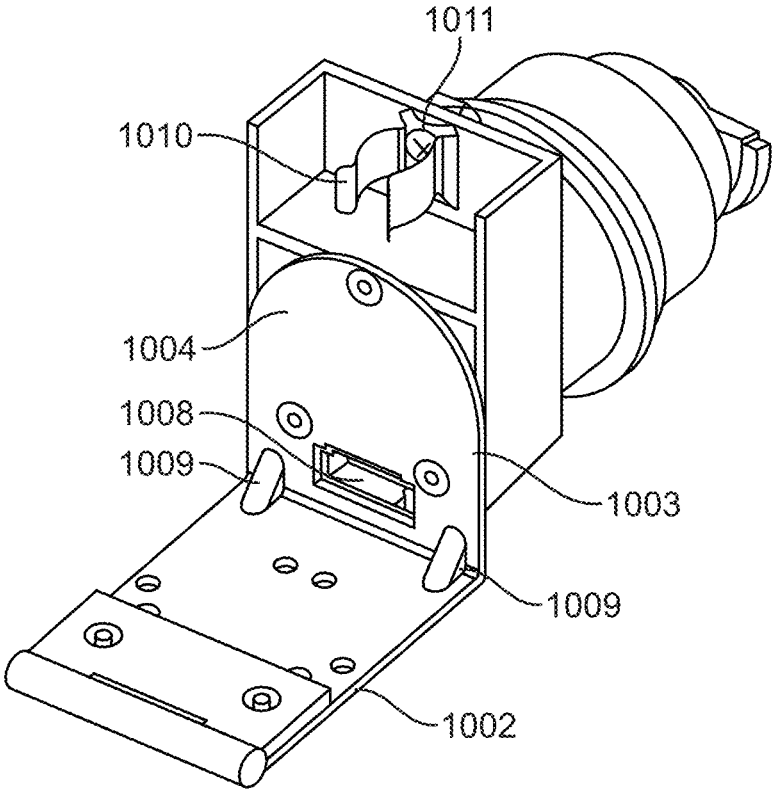
FIG. 5B is a rear view of another exemplary independent suspension system connected to a respective motor pod/wheel assembly.

Referring now to FIGS. 5A and 5B, there are shown perspective front and rear views of another exemplary independent suspension system 1000 connected to a respective motor pod/wheel assembly. The system 1000 includes a hinge component 1002 attached to a metal bracket 1003 including a right-angled vertical flange portion 1004. A plastic motor pod 1090 attaches to the vertical flange of the metal bracket 103. The motor pod 1090 houses a drive motor and motor controller. Pressed to the motor end is a drive hub and quick connect clip for the wheel. A pod ring of low friction material is pressed about the outer diameter of the motor pod 1090. The ring provides a low friction, low wear, bearing surface for the wheel.

As shown in FIG. 5B, a receptacle 1008 for plugging to the wheel motor controller is located in the rear of the wheel bracket 1003 on the vertical flange portion 1003. In the depicted embodiment, the bracket 1003 is shown stiffened with gussets 1009. A spring steel tool clip 1010 is mounted to the top of the motor pod 1090. The clip 1010 can be adjusted by tightening or loosening a mounting screw 1011, which closes/opens the opening of the clip 1010. The clip 1010 provides a flexible pinching force that can hold the wheel assembly in the closed position or easily be overcome to open the wheel assembly for cleaning or service.

Figure 6:
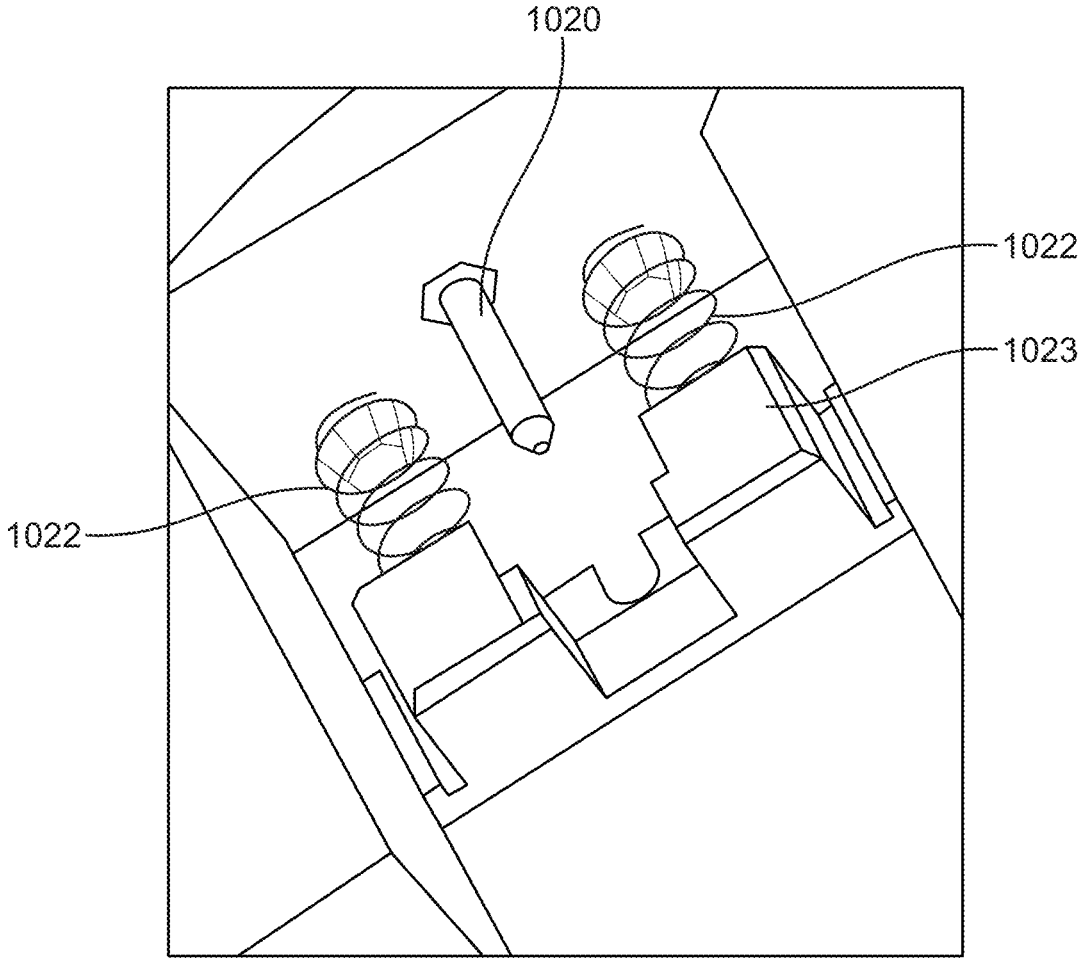
FIG. 6 is a tapered suspension pin, two compression springs, and a spring holster, which are mounted in each wheel well of the robotic platform.
Figure 7:
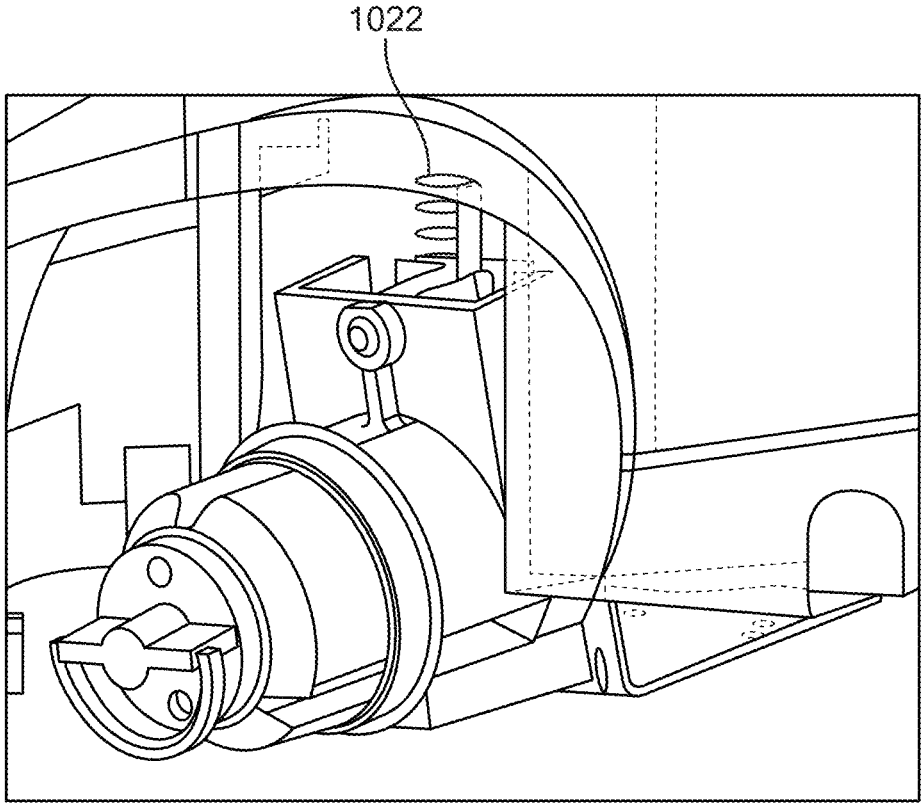
FIG. 7 is the springs providing limited, independent up/down movement of each motor pod/wheel assembly.

Turning now to FIG. 6, there is shown a tapered suspension pin 1020, two compression springs 1022, and a spring holster 1023, which are mounted in each wheel well of the robotic platform. As the suspension system 1000 is rotated from an open position to a near horizontal, operational closed position, the suspension pin 1020 engages the spring clip 1010. Once seated, the springs 1022 provide limited, independent up/down movement of each motor pod/wheel assembly, as schematically illustrated in FIG. 7. The wheel bracket 1003 can be opened by rotating the wheel bracket 1003 until the suspension pin 1020 snaps out of the tool clip 1010. The springs 1022 can be unique for each wheel to provide balanced support to the robotic vacuum.

The suspension system 1000 allows the wheel bracket 1003 to be pivoted from the clip 1010 for service, removal, or replacement of the wheel without the need for special tools. The engagement of the pin 1020 with the spring clip 1010 is chosen to provide a low enough force for easy opening and closing of the brackets 1003 (approximately 1.5 lbs.) while maintaining sufficient force to hold the wheel assemblies within the clip 1010 during lifting and normal handling of the robotic vacuum cleaner. A commercial "tool holder" spring clip 1010 is shown for low cost and commercial availability. Hardened springs 1022 provide consistent deflection and force over many cycles. The spring clip 1010 assembly may comprise other types of springs and clips as a person skilled in the art would appreciate.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The above-described embodiments of the described subject matter can be implemented in any of numerous ways. For example, some embodiments may be implemented using hardware, software or a combination thereof. When any aspect of an embodiment is implemented at least in part in software, the software code can be executed on any suitable processor or collection of processors, whether provided in a single device or computer or distributed among multiple devices/computers.

What is claimed is:

1. An independent suspension system for a robot vacuum cleaner, comprising:

a. a hinge component attached to an L-shaped bracket having a horizontal flange portion and a vertical flange portion;

b. wherein the vertical flange portion is attached to a wheel assembly of the robot vacuum cleaner;

c. a spring coupled to the horizontal flange portion;

d. a pin attached to and extending from the vertical flange portion;

e. a holding component within a wheel well of the robot vacuum cleaner; and f. wherein the holding component is movable between an engaged configuration with the pin and a disengaged configuration with the pin.

2. The independent suspension system of claim 1, wherein the wheel assembly is rotatable approximately 180 degrees about the hinge component.

3. The independent suspension system of claim 1, wherein the spring is one of a leaf spring, a compression spring, and a torsion spring.

4. The independent suspension system of claim 3, wherein the bumpers are composed of resilient material.

5. The independent suspension system of claim 1, further comprising one or more bumpers attached to at least one of the horizontal flange portion and the vertical flange portion.

6. An independent suspension system for a robot vacuum cleaner, comprising:

a. a hinge component attached to an L-shaped bracket having a horizontal flange portion and a vertical flange portion;

b. wherein the vertical flange portion is attached to a motor pod of the robot vacuum cleaner, the motor pod housing the drive motor and motor controller of the robot vacuum cleaner;

c. a clip mounted to the motor pod;

d. a suspension pin mounted between two springs in a spring holster in a wheel well of the robot vacuum cleaner; and e. wherein the motor pod is rotatable about the hinge component between an open position wherein the suspension pin does not engage the clip and a closed position wherein the suspension pin engages the clip.

7. The independent suspension system of claim 6, wherein gussets extend between the horizontal flange portion and the vertical flange portion of the L-shaped bracket.

8. The independent suspension system of claim 6, wherein the two springs are compression springs.

9. The independent suspension system of claim 6, further comprising a receptacle configured for connection to a wheel motor controller.

* * * * *